US010195709B2

(12) United States Patent
Bannayan et al.

(10) Patent No.: US 10,195,709 B2
(45) Date of Patent: Feb. 5, 2019

(54) MOTORIZED BLADE REST APPARATUS AND GRINDING SYSTEM WITH MOTORIZED BLADE REST APPARATUS

(71) Applicant: Glebar Acquisition, LLC, Ramsey, NJ (US)

(72) Inventors: John Bannayan, New York, NY (US); Robert C. Gleason, Butler, NJ (US)

(73) Assignee: GLEBAR ACQUISITION, LLC, Ramsey, NJ (US)

( * ) Notice: Subject to any disclaimer, the term of this patent is extended or adjusted under 35 U.S.C. 154(b) by 635 days.

(21) Appl. No.: 14/797,854

(22) Filed: Jul. 13, 2015

(65) Prior Publication Data

US 2016/0229021 A1 Aug. 11, 2016

Related U.S. Application Data

(60) Provisional application No. 62/113,716, filed on Feb. 9, 2015.

(51) Int. Cl.

| | |
|---|---|
| ***B24B 5/04*** | (2006.01) |
| ***B24B 5/18*** | (2006.01) |
| ***B24B 5/22*** | (2006.01) |
| ***B24B 5/307*** | (2006.01) |
| ***B24B 5/32*** | (2006.01) |
| ***B24B 49/10*** | (2006.01) |
| ***B24B 5/38*** | (2006.01) |
| ***B24B 5/37*** | (2006.01) |

(52) U.S. Cl.

CPC ..... *B24B 5/307* (2013.01); *B24B 5/04* (2013.01); *B24B 5/18* (2013.01); *B24B 5/22* (2013.01); *B24B 5/32* (2013.01); *B24B 5/37* (2013.01); *B24B 5/38* (2013.01); *B24B 49/10* (2013.01)

(58) Field of Classification Search

CPC .... B24B 5/02; B24B 5/04; B24B 5/18; B24B 5/22; B24B 5/30; B24B 5/307; B24B 5/32; B24B 5/37; B24B 5/38; B24B 49/10

USPC ..... 451/5, 11, 48, 51, 242, 246

See application file for complete search history.

(56) References Cited

U.S. PATENT DOCUMENTS 2,127,210 A * 8/1938 Dunbar ..... B24B 47/06 29/37 A
4,507,896 A * 4/1985 Smith ..... B24B 5/22 451/242
4,580,368 A * 4/1986 Smith ..... B24B 5/22 451/11

(Continued)

*Primary Examiner* — Eileen Morgan
(74) *Attorney, Agent, or Firm* — Venable LLP

(57) ABSTRACT

A motorized blade rest apparatus for a grinding system includes a carriage, a ram assembly, a work rest assembly, a motor, and a computer processor. The carriage moves a regulating wheel along a first axis towards and away from a work wheel. The ram assembly, which moves along a second axis parallel to the first axis, supports the carriage and the work rest assembly. The work rest assembly includes first and second slide portions and a work rest blade. The first slide portion is mounted on the ram assembly. The second slide portion, which is movable relative to the first slide portion, moves along a third axis perpendicular to the first axis. The work rest blade is mounted on the second slide portion. The motor is coupled to the second slide portion, and the computer processor controls the motor to move the second slide portion along the third axis.

41 Claims, 15 Drawing Sheets

(56) References Cited

U.S. PATENT DOCUMENTS

| | | | | | |
|---|---|---|---|---|---|
| 4,712,332 | A * | 12/1987 | Smith | B24B 5/22 | 451/244 |
| 5,766,057 | A * | 6/1998 | Maack | B24B 5/35 | 451/194 |
| 6,312,318 | B1 * | 11/2001 | Mushardt | B24B 5/24 | 451/177 |
| 6,569,000 | B1 * | 5/2003 | Mushardt | B24B 5/18 | 451/243 |
| 7,223,159 | B2 * | 5/2007 | Tschudin | B24B 5/307 | 451/182 |
| 8,579,680 | B2 | 11/2013 | Schellenberg et al. | | 451/242 |
| 9,085,059 | B2 | 7/2015 | Tschudin et al. | B24B 5/22 | |

* cited by examiner

ITEM # DESCRIPTION

| PARTS LIST | |
|---|---|
| ITEM | DESCRIPTION |
| 1 | SENSOR |
| 2 | MOTOR, STEPPER, W/ ENCODER |
| 3 | SCREW |
| 4 | SCREW |
| 5 | NUT |
| 6 | SCREW |
| 7 | SCREW |
| 8 | SCREW |
| 9 | SCREW |
| 10 | SCREW |
| 11 | SCREW |
| 12 | SCREW |
| 13 | SCREW |
| 14 | WASHER |
| 15 | PLATE, END, LEFT |
| 16 | COVER |
| 17 | MOUNT, CLAMP ARM |
| 18 | MOUNT, LEAD SCREW |
| 19 | PLATE, END, RIGHT |
| 20 | RAMP, WORK REST BLADE |
| 21 | ARM, CLAMP |
| 22 | MOUNT, MOTOR |
| 23 | SLIDE, LOWER (FIRST SLIDE) |
| 24 | SLIDE, UPPER (SECOND SLIDE) |
| 25 | LEAD SCREW & NUT ASSEMBLY |
| 26 | COUPLING |
| 27 | LINEAR GUIDE |
| 28 | SPRING |

FIG. 6B

MOTORIZED BLADE REST APPARATUS AND GRINDING SYSTEM WITH MOTORIZED BLADE REST APPARATUS

CROSS-REFERENCE TO RELATED APPLICATION

The present application claims the benefit of U.S. Provisional Application No. 62/113,716 filed on Feb. 9, 2015, the entire disclosure of which is incorporated by reference herein.

FIELD OF THE INVENTION

The present invention relates to grinding systems and more specifically to a motorized blade rest apparatus useable with a grinding system such as a centerless grinding system.

RELATED ART

A conventional centerless grinder 122, schematically shown in FIG. 1, typically includes a work wheel 126 and a regulating wheel 128, which work together to grind a workpiece 124 positioned between the two wheels 126, 128. The grinder 122 includes a work rest blade 108, which functions to support the workpiece 124 during grinding. The regulating wheel 128 is physically linked to the blade 108 such that they move in tandem in the directions shown by the arrow A. The work wheel 126 may be configured to move independently of the blade 108 and the regulating wheel 128, in the directions shown by the arrow B.

In a so-called "plunge-grind" type of grinding operation, the workpiece 124 is placed on the blade 108, and the work wheel 126 is moved towards the workpiece, or the workpiece 124 is moved toward the work wheel 126, or both. With this type of arrangement, the workpiece 124 can be ground to a have a surface profile that complements the profile of the work wheel 126, such as shown schematically in FIG. 2.

FIG. 3 schematically shows multiple workpieces 124 being plunge-ground by the work wheel 126. With a conventional arrangement such as the grinder 122, each of the workpieces 124 takes on the profile of the work wheel 126.

BRIEF DESCRIPTION OF THE INVENTION

With a conventional arrangement such as that described above, when it is desirable for a workpiece to have a profile that is different from the profile of the work wheel, the workpiece must be moved after grinding, or the work wheel must be changed to another work wheel having a different profile, or both. Aspects of the present invention address this deficiency in prior-art grinders.

According to a first aspect of the invention, a blade rest apparatus is provided. The blade rest apparatus may be coupled to a regulating wheel such that the blade rest apparatus is movable together with the regulating wheel along a first axis or orientation, i.e., in directions towards and away from a work wheel. The blade rest apparatus also is movable along a second axis or orientation, perpendicular to the first axis, independently of movement along the first axis. That is, the blade rest apparatus may be moved in lateral directions perpendicular to the directions of the first axis towards and away from the work wheel.

According to an embodiment of the first aspect, the blade rest apparatus is motorized to move along the second axis, and is controlled by a computer to move a predetermined lateral distance according to a computer program. The lateral movement may be continuous during grinding or may occur in a stop-start type sequence between grinding steps.

According to another embodiment of the first aspect, the blade rest apparatus or a portion of the blade rest apparatus is moved mechanically using a mechanical device. For example, the mechanical device may be a flexure device, which moves the blade rest apparatus or the portion thereof to a mechanical stop. The mechanical stop may be a fixed stop or an adjustable stop.

According to a second aspect of the invention, the blade rest apparatus according to the first aspect is incorporated in a grinding system.

According to a third aspect of the invention, a method of grinding a workpiece is provided in which a blade rest apparatus according to the first aspect is utilized.

BRIEF DESCRIPTION OF THE DRAWINGS

Aspects and embodiments of the present invention will be more readily understood from a detailed description of the invention, provided below, considered in conjunction with the attached drawings, of which:

FIG. 6B shows a parts list for the parts shown in FIG. 6A;

DETAIL DESCRIPTION OF THE INVENTION

Figure 1:
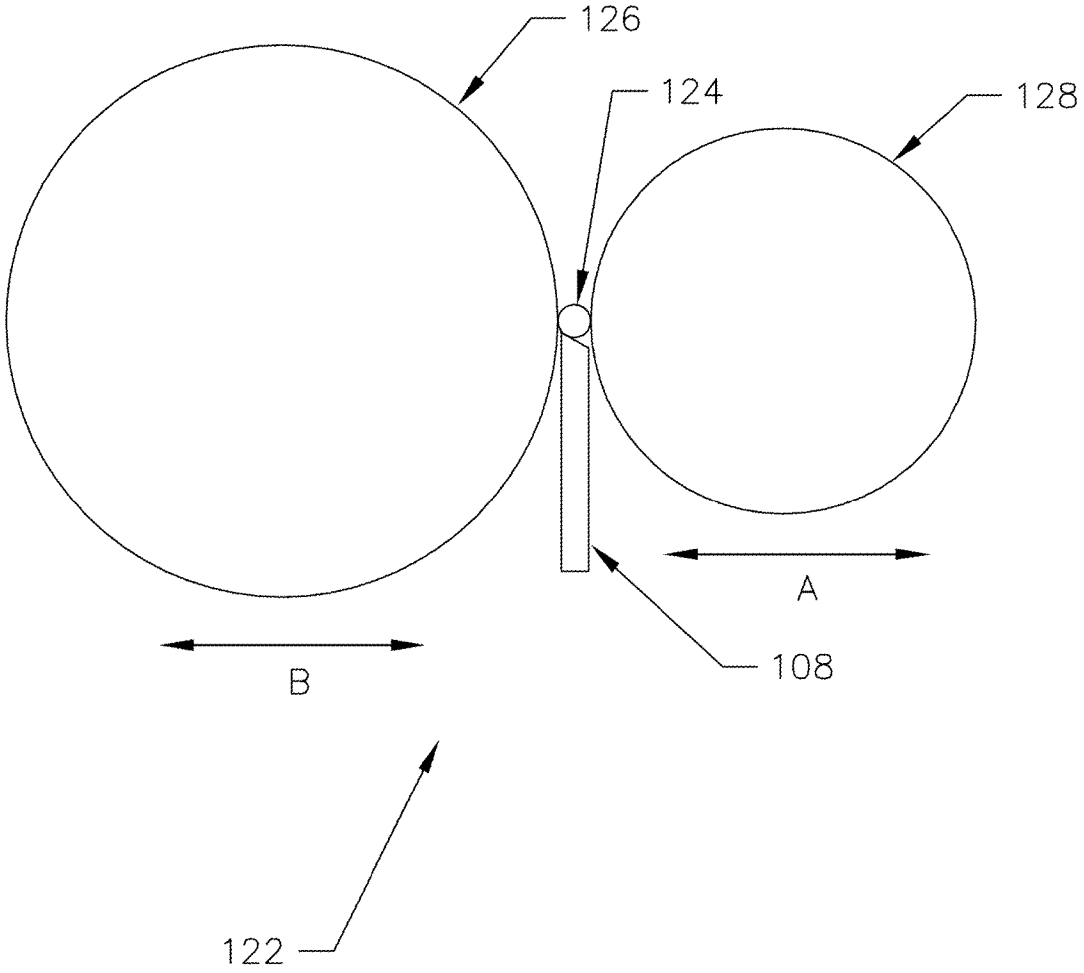
FIG. 1 schematically shows a conventional grinding system.
Figure 2:
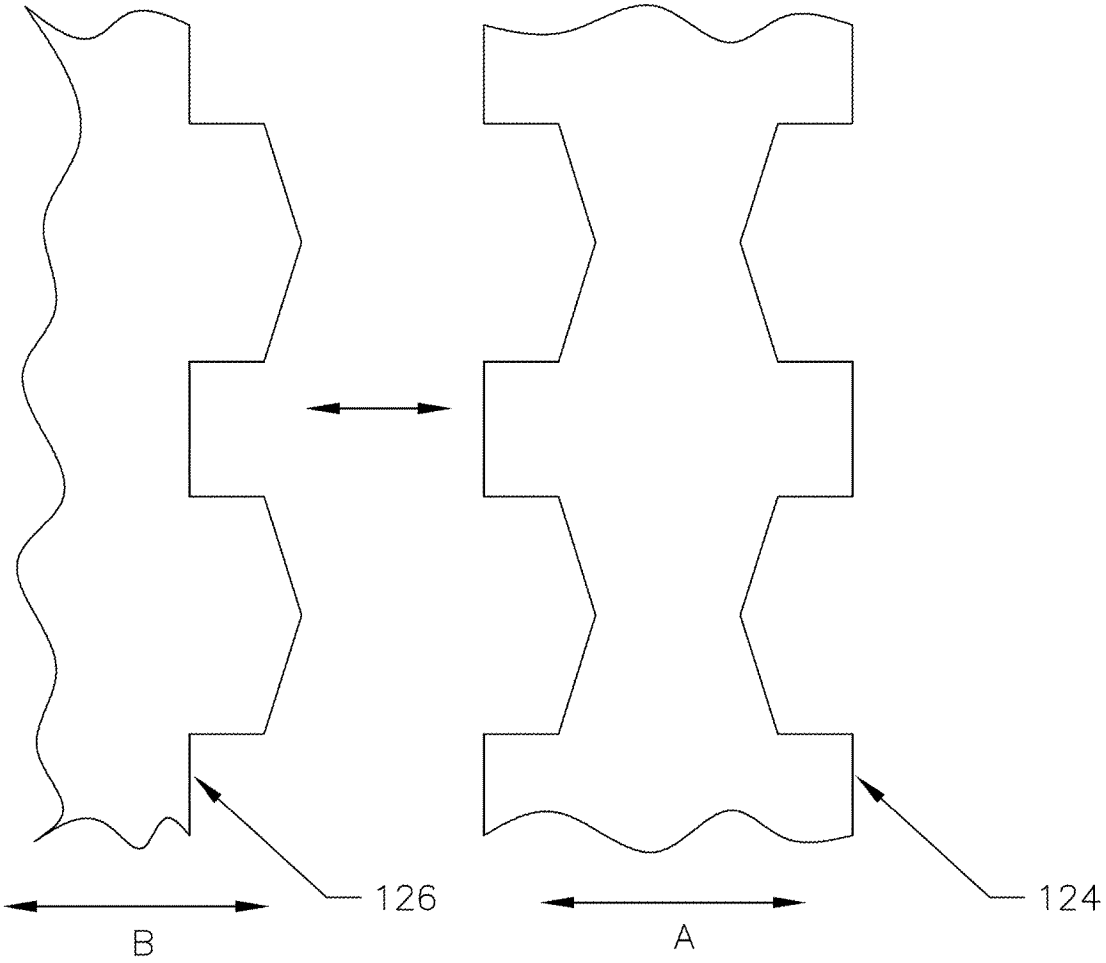
FIG. 2 schematically shows a workpiece that has been plunge-ground by a work wheel.
Figure 3:
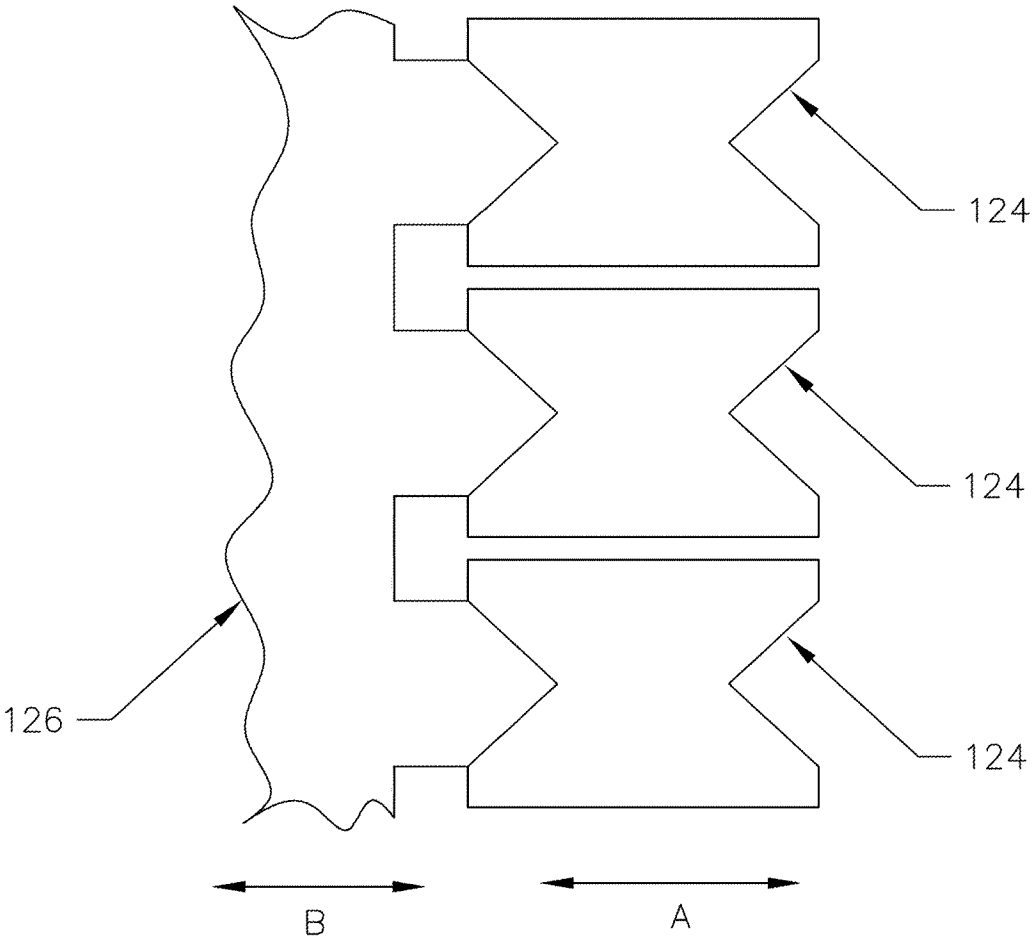
FIG. 3 schematically shows a plurality of workpieces that have been plunge-ground by a work wheel.
Figure 4:
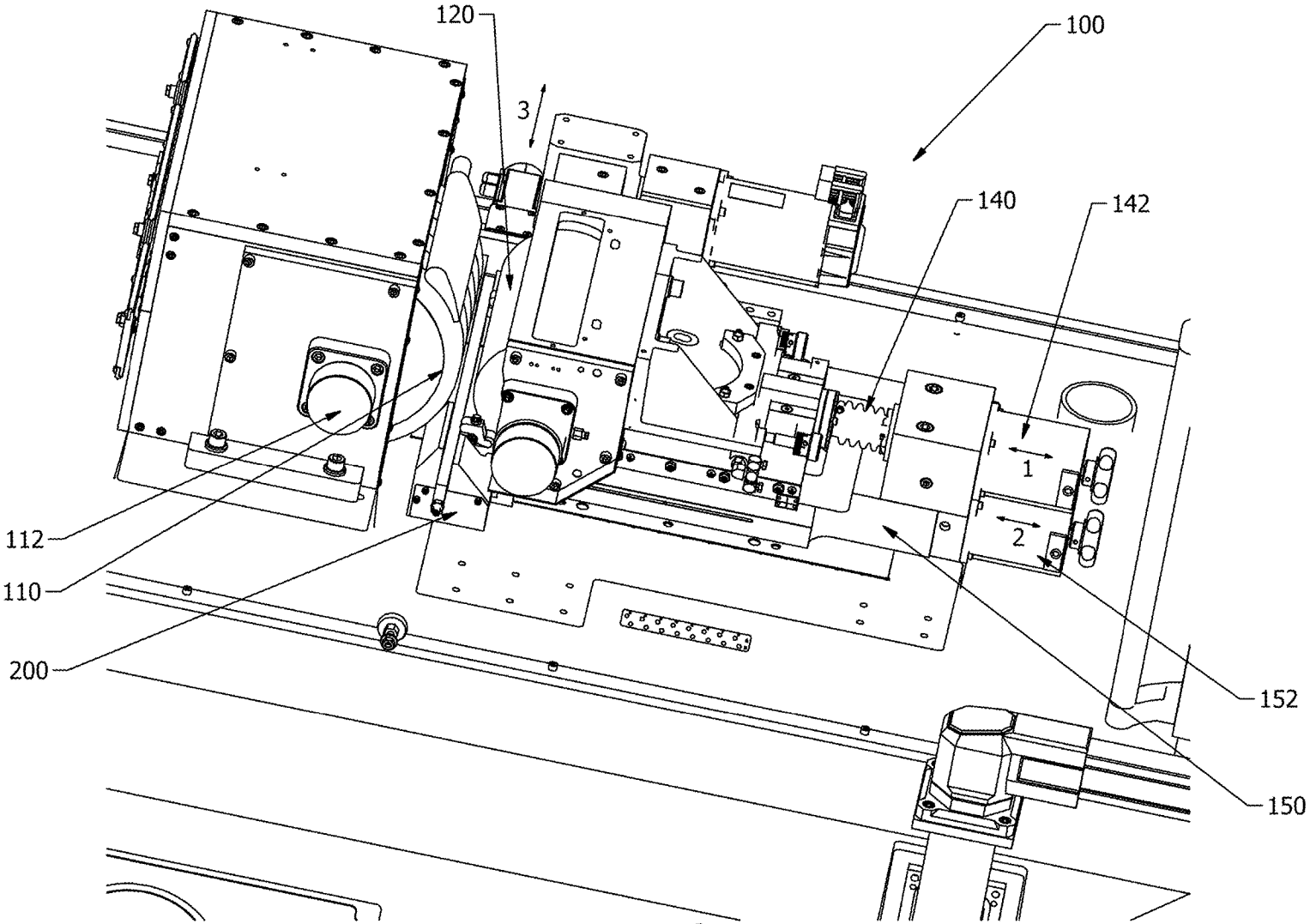
FIG. 4 schematically depicts a grinding system according to an embodiment of the present invention.

FIG. 4 schematically depicts a grinding system 100 according to an aspect of the invention. A work wheel 110 of the system 100 includes a grinding surface and is positioned to grind a workpiece (not shown). A grinding motor 112 is coupled to the work wheel 110 to cause rotation of the work wheel 110. A regulating wheel 120 of the system 100 is positioned to brace the workpiece against the work wheel 110 during grinding. The workpiece is supported by a work rest assembly 200 of the system 100.

A movable carriage 140 of the system 100 supports the regulating wheel 120 for movement along a first axis 1 towards and away from the work wheel 110.

Although the work wheel 110 is depicted to be stationary, the work wheel 110 optionally may be mounted on a carriage (not shown), which supports the work wheel 110 for movement towards and away from the work rest assembly 200.

A movable ram assembly 150 of the system 100 supports the carriage 140 and is structured for movement along a second axis 2 towards and away from the work wheel 110. The first axis 1 is parallel to the second axis 2.

Figure 5A:
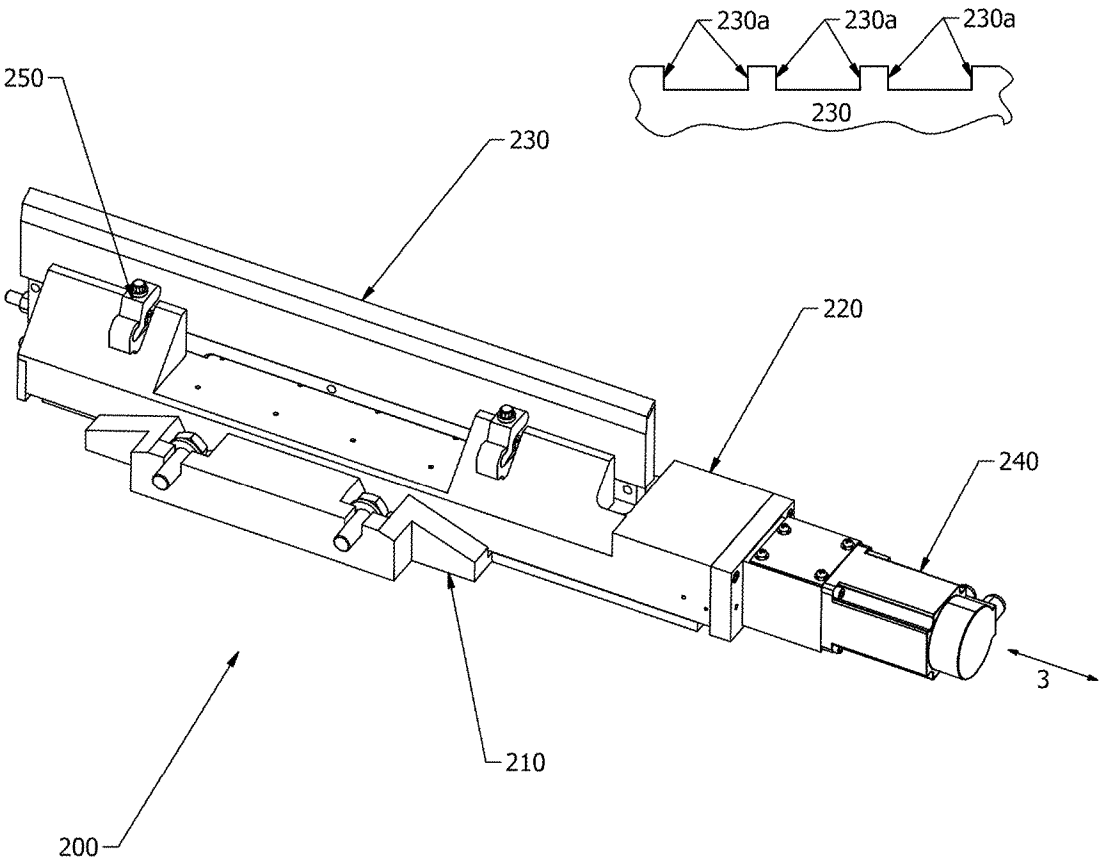
FIG. 5A schematically depicts a front perspective view of a work rest assembly according to an embodiment of the present invention.
Figure 5B:
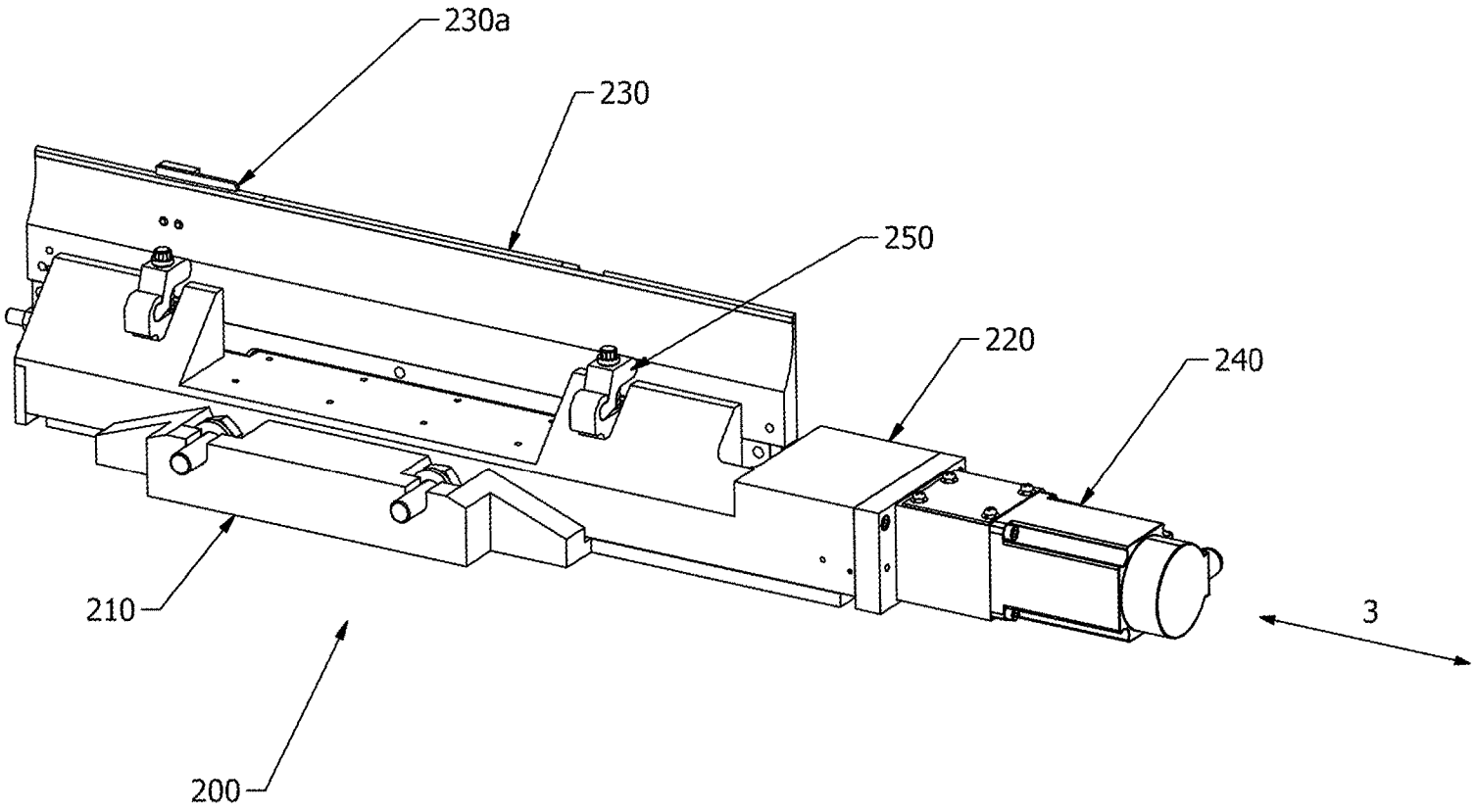
FIG. 5B schematically depicts another front perspective view of the work rest assembly.
Figure 5C:
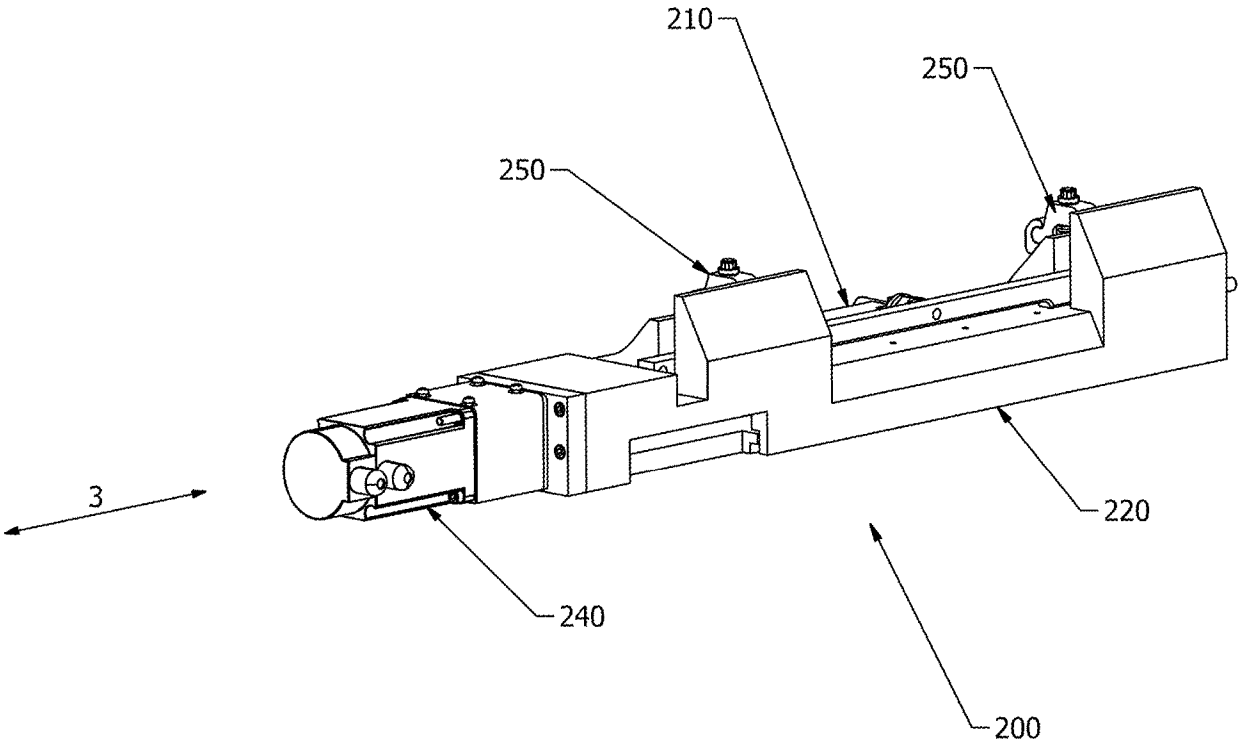
FIG. 5C schematically depicts a rear perspective view of the work rest assembly.

The work rest assembly 200 is supported by the ram assembly 150. As shown in FIGS. 5A, 5B, and 5C, the work rest assembly 200 includes a first slide portion 210, which is mounted on the ram assembly 150, and a movable second slide portion 220, which is movable relative to the first slide portion 210. The second slide portion 220 is structured to move along a third axis 3, which is perpendicular to the first axis 1 (see FIG. 4).

A work rest blade 230 of the assembly 200 is mounted on the second slide portion 220 and structured to support a workpiece (not shown) to be ground by the work wheel 110. For example, the work rest blade 230 may be attached to the second slide portion 220 via a clamp 250. For the sake of simplicity, the work rest blade 230 is shown in FIG. 5A to have a straight edge or supporting surface. It practice, the work rest blade 230 can have physical stops 230*a*, such as trenches or ridges, to hold one or a plurality of workpieces during grinding, to prevent the workpiece(s) from unwanted lateral shifting during grinding. An example of such physical stops 230*a* is shown in the inset in FIG. 5A, as well as in FIG. 5B.

A work rest motor 240 is operatively coupled to the second slide portion 220 to move the second slide portion 220 along the third axis 3. In an embodiment, the work rest motor 240 is a stepper motor. In another embodiment, the work rest motor 240 is a servo motor. Although an encoder is not necessary, the work rest motor 240 optionally may include an encoder, such as a linear encoder or a rotary encoder.

A computer processor (not shown) is operatively coupled to the work rest motor 240 and is programmed to control the work rest motor 240 to controllably move the second slide portion 220 along the third axis 3.

Optionally, the carriage 140 is motorized via a carriage motor 142 attached to the carriage 140. The computer processor is operatively coupled to the carriage motor 142 and is programmed to control the carriage motor 142 to controllably move the carriage 140 along the first axis 1 towards and away from the work wheel 110.

In an embodiment, the computer processor controls the work rest motor 240 independently of the carriage motor 142, such that the second slide portion 220 is controlled to move along the third axis 3 independently of movement of the carriage 140 along the first axis 1.

In an embodiment, the computer processor controls the carriage motor 142 and the work rest motor 240 to move the carriage 140 and the second slide portion 220 simultaneously, such that the second slide portion 220 is controlled to move along the third axis 3 while the carriage 140 is moved along the first axis 1.

Optionally, the ram assembly 150 is motorized via a ram motor 152. The computer processor is operatively coupled to the ram motor 152 and is programmed to control the ram motor 152 to controllably move the ram assembly 150 along the second axis 2 towards and away from the work wheel 110.

In an embodiment, the computer processor controls the carriage motor 142, the ram motor 152, and the work rest motor 240 independently of each other, such that the carriage 140, the second slide portion 220, and the ram assembly 150 are controllably movable independent of each other.

In an embodiment, the work rest motor 240 is controlled by the computer processor to move the second slide portion 220 along the third axis 3 while a workpiece is being ground.

In an embodiment, the computer processor is programmed to control the work rest motor 240 to controllably move the second slide portion 220 such that a workpiece is ground to a predetermined shape set by a code used to program the computer processor.

In an embodiment, the carriage motor 142 is controlled by the computer processor to move the carriage 140 along the first axis 1, and the work rest motor 240 is controlled by the computer processor to move the second slide portion 220 along the third axis 3, while a workpiece is being ground.

In an embodiment, the carriage motor 142 and the work rest motor 240 are controlled by the computer processor to move the carriage 140 and the second slide portion 220 simultaneously while a workpiece is being ground. That is, a lateral position of the workpiece and a longitudinal position of the workpiece change simultaneously during grinding, such that the workpiece moves in a direction that forms a non-zero angle with the first axis 1 and a non-zero angle with the third axis 3.

In an embodiment, the carriage motor 142 and the work rest motor 240 are controlled by the computer processor to move the carriage 140 and the second slide portion 220 sequentially while a workpiece is being ground. That is, the workpiece moves in a direction parallel to the first axis 1 or in a direction perpendicular to the first axis 1, but not both simultaneously.

Figure 6A:
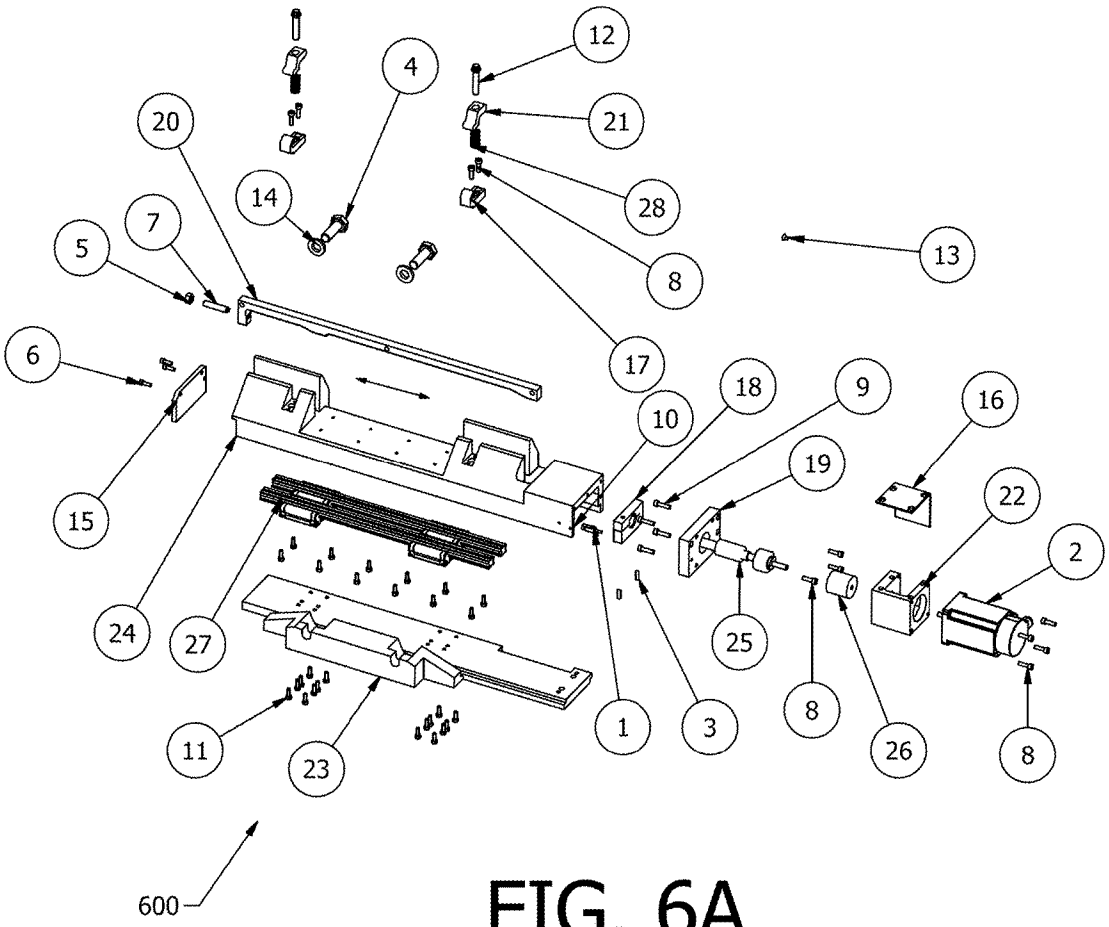
FIG. 6A schematically depicts an exploded view showing parts of a work rest assembly according to an embodiment of the present invention.

FIG. 6A depicts an exploded view showing parts of a work rest assembly 600 according to an embodiment of the invention. In this embodiment, a second slide portion 29 is mounted for movement on a linear guide 32 supported by the first slide portion 28. For example, the linear guide 32 may be a rail or a plurality of rails. The first slide portion 28 is mountable to a carriage (not shown) similar to the carriage 140. FIG. 6B shows a parts list identifying the parts shown in FIG. 6A. The linear guide 32 enables the second slide 29 to move in a lateral direction shown by the arrow.

In an embodiment, the system 100 includes a carriage rail (not shown) on which the carriage 140 is mounted for movement along the first axis 1.

In an embodiment, the system 100 includes a ram-assembly rail (not shown) on which the ram assembly 150 is mounted for movement along the second axis 2.

Figure 7A:
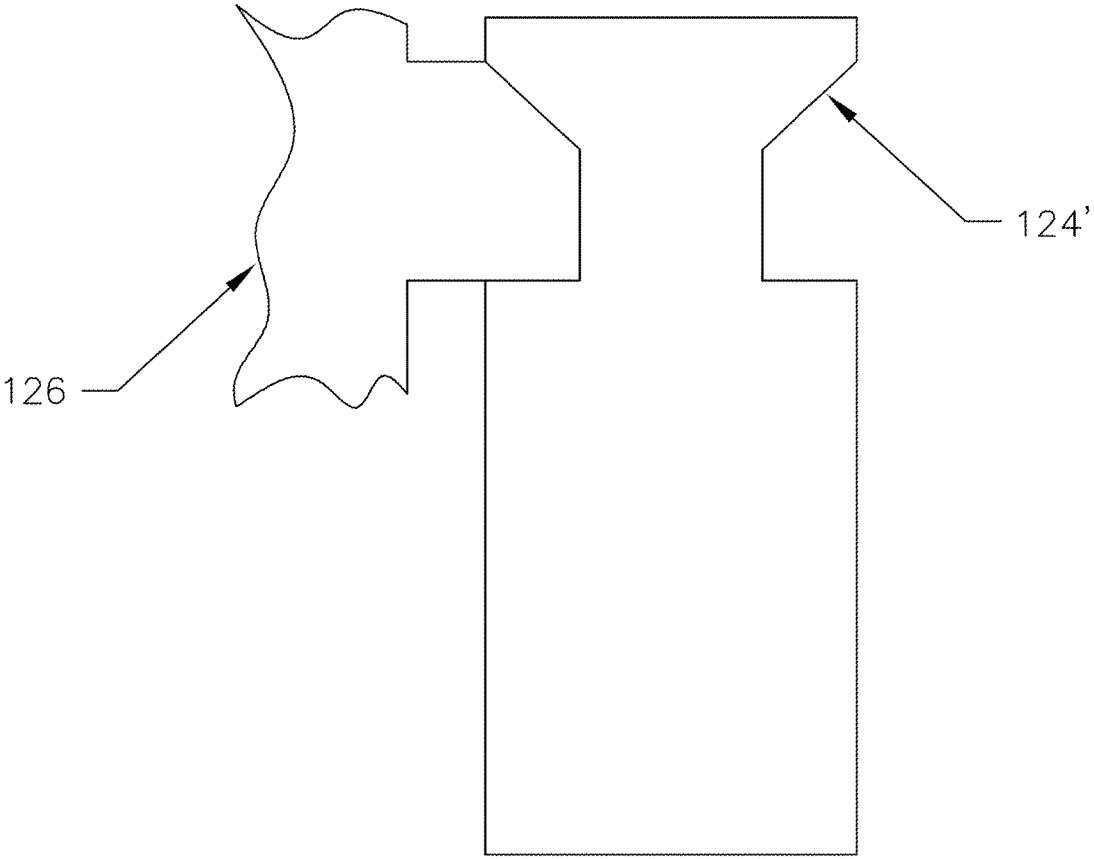
FIGS. 7A through 7D schematically depict a grinding progression of a workpiece.
Figure 7B:
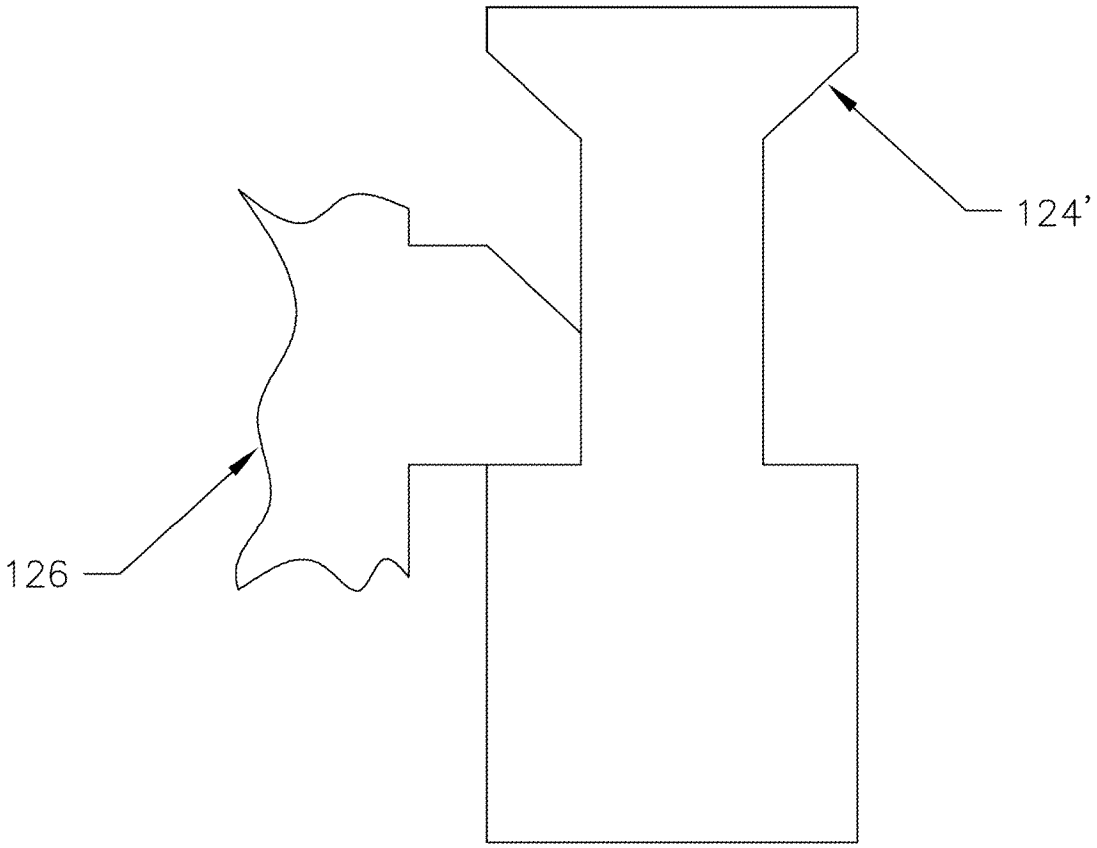
Figure 7C:
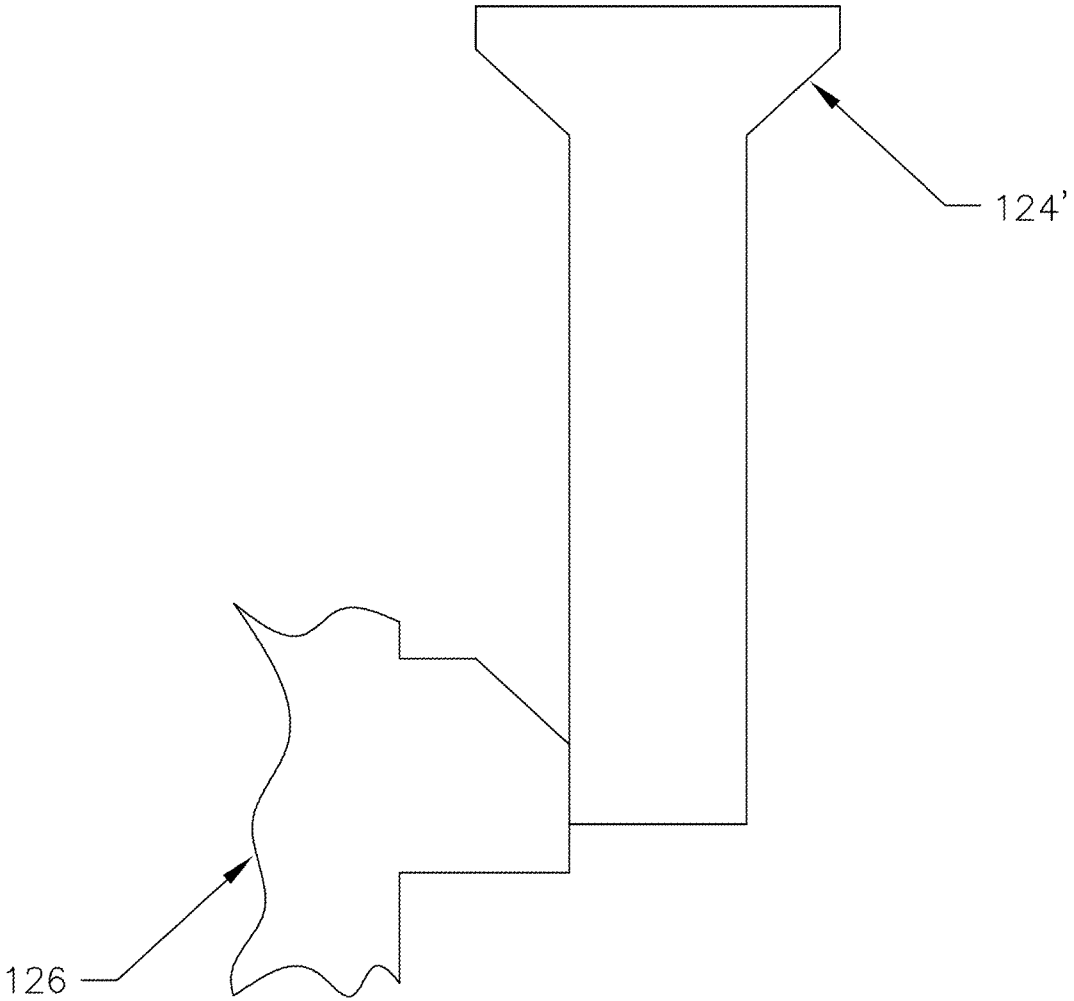
Figure 7D:
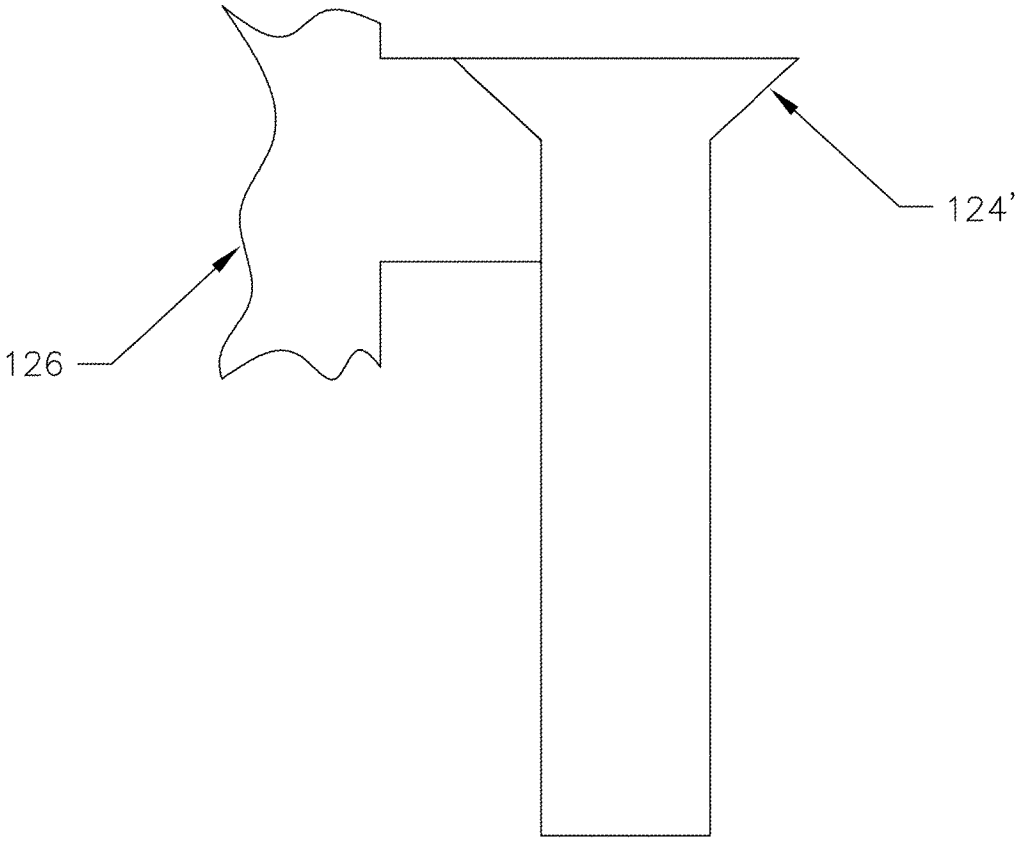

Because the system 100 enables motion along the first axis, the second, and the third axis to be controlled independently, a grinding operation can be automatically controlled to produce a ground workpiece 124' having a shape that progresses according to the schematic depictions shown in FIGS. 7A through 7D, in which FIG. 7A shows the workpiece 124' being ground after being moved along the first axis 1 in a first direction toward the work wheel 126; FIG. 7B shows the workpiece 124' of FIG. 7A after being moved in a second direction along the third axis 3 and ground, the second direction being perpendicular to the first direction; FIG. 7C shows the workpiece 124' of FIG. 7B after being further moved in the second direction along the third axis 3 and ground; and FIG. 7D shows the workpiece 124' of FIG. 7C after being moved in a third direction (opposite the second direction) along the third axis 3 and ground. The sequence shown in FIGS. 7A through 7D may be performed in one continuous grinding operation without the need to re-position the workpiece 124' on the work rest blade 230.

FIGS. 7A through 7D show one possible sequence for a grinding operation, and other sequences having more or fewer steps are possible and are within the scope of the present invention. Additionally, FIGS. 7A through 7D show one possible work wheel profile, and other profiles may be used and are within the scope of the present invention.

In another aspect of the present invention, a movable blade rest apparatus 900 is provided for a grinding system. Features of this aspect that are the same or similar to the above-described aspect are designated by the same reference numerals.

Figure 8:
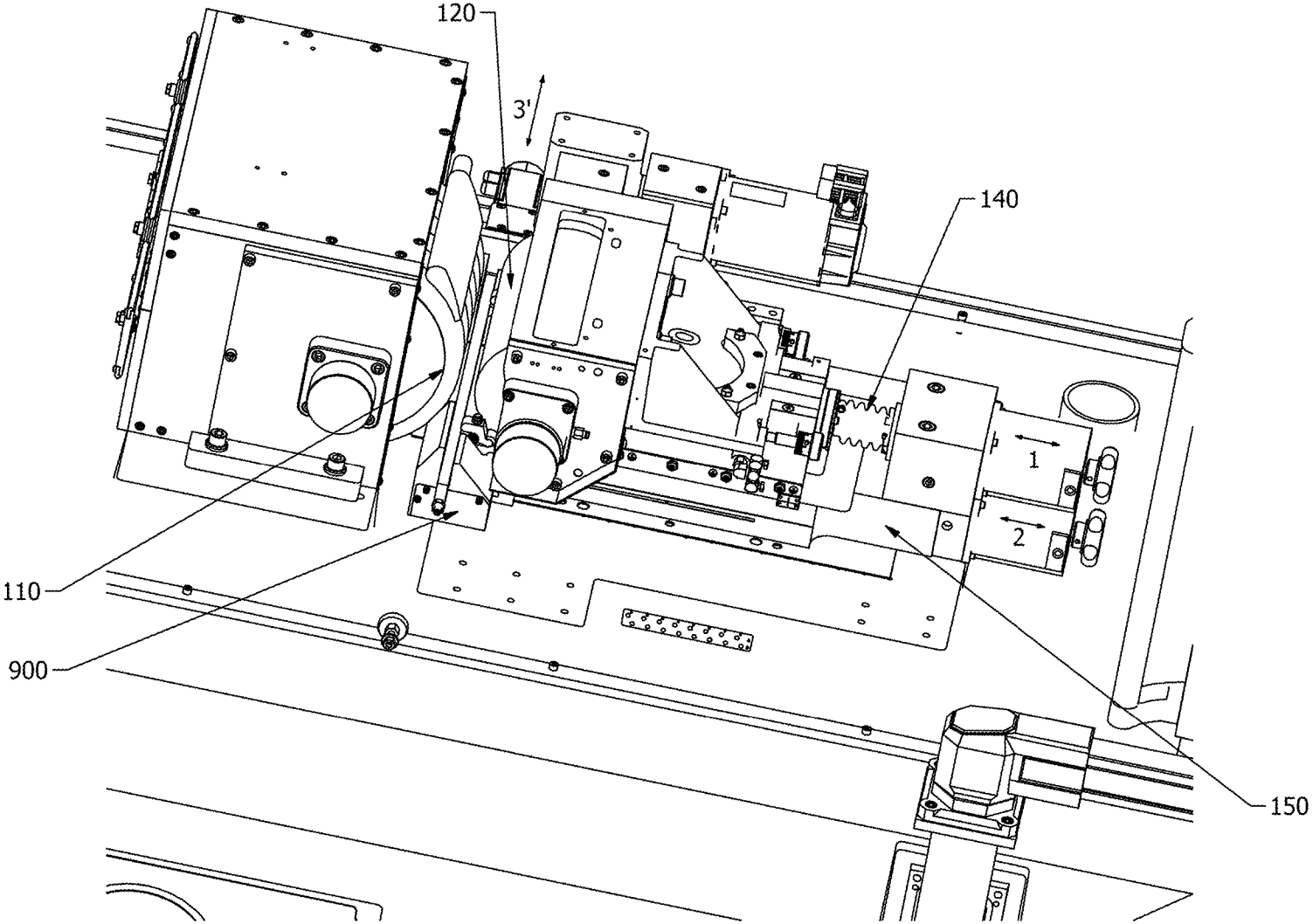
FIG. 8 schematically depicts a movable blade rest apparatus according to an embodiment of the present invention.

As shown in FIG. 8, a movable carriage 140 is configured to support a regulating wheel 120 for movement along a first axis 1 towards and away from a work wheel 110. A movable ram assembly 150 supports the carriage 140 and is structured for movement along a second axis 2 towards and away from the work wheel 110. The first axis 1 is parallel to the second axis 2. A work rest assembly 900 is supported by the ram assembly 150.

Figure 9:
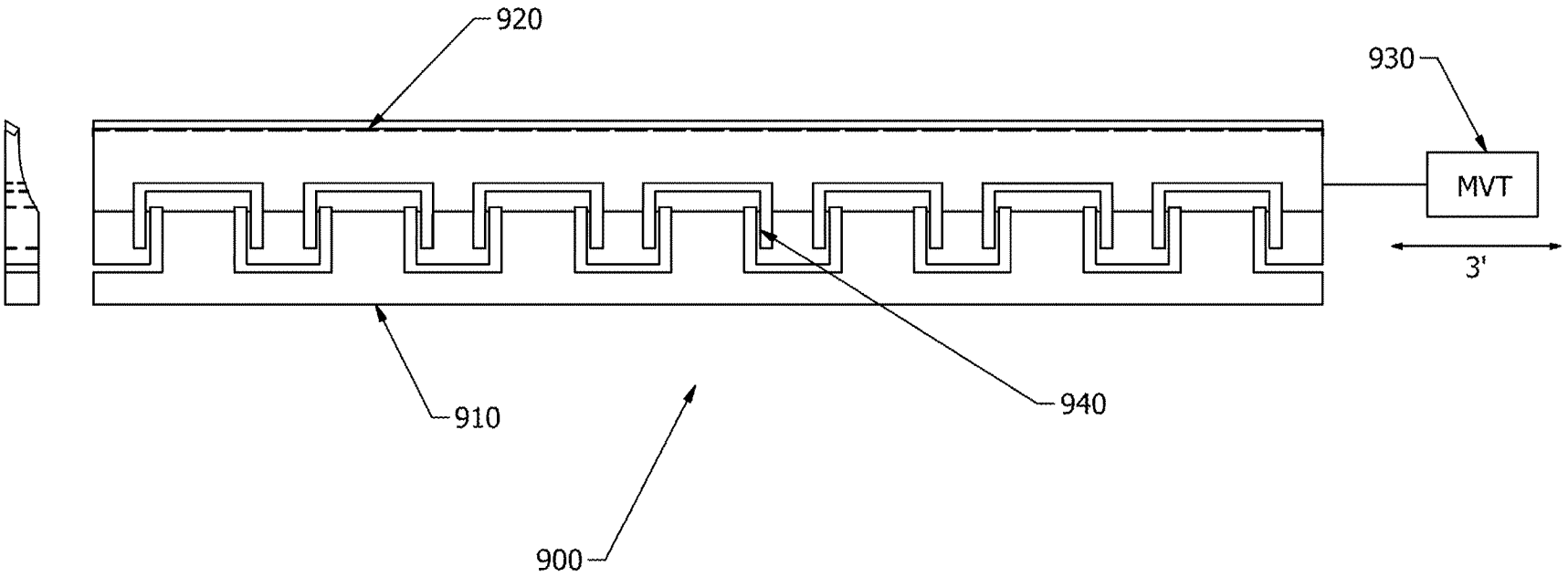
FIG. 9 schematically depicts a work rest assembly according to an embodiment of the present invention.

As shown in FIG. 9, the work rest assembly includes a fixed portion 910, which is mounted on the ram assembly 150, and a movable work rest blade portion 920, which is supported by the fixed portion 910 and is structured for movement along a third axis 3' perpendicular to the first axis 1 (see FIG. 8). The work rest blade portion 920 is movable relative to the fixed portion 910 and is configured to support a workpiece or a plurality of workpieces (not shown) to be ground by the work wheel 110. A movement mechanism 930 is coupled to the work rest blade portion 920 and exerts force to move the work rest blade portion 920 along the third axis 3'.

The movement mechanism 930 may be any mechanism (mechanical, electromechanical, electromagnetic, and the like) able to exert a force on the work rest blade portion 920 to move the work rest blade portion 920. For example, the movement mechanism may be a stepper motor, a servo motor, a programmable cylinder, a piezoelectric motor, a motorized or mechanical screw, or the like.

In an embodiment, the movement mechanism 930 is a mechanical spring that, when released, exerts a force that moves the work rest blade portion 920 to a mechanical stop (not shown). The mechanical stop may be a fixed structural ledge or bump that prevents the work rest blade portion 920 from moving further, or the mechanical stop may be an adjustable stop. For example, the adjustable stop may be movable by a motor controlled by a computer to move in a pre-set distance increment every pre-set time interval.

In an embodiment, the fixed portion 910 and the work rest blade portion 920 are structured to be a flexure device with a plurality of flexure portions 940, as shown in FIG. 9. The mechanics of flexure devices are known in the art and FIG. 9 shows only one possible arrangement. Other flexure-type arrangements may be used and are within the scope of the present invention.

In this aspect, as with the aspect described above, movement of the work rest blade portion 920 in a direction along the third axis 3' causes movement of a workpiece or a plurality of workpieces supported by the work rest blade portion 920. Such an arrangement makes it possible for a plunge-grinding operation on the workpiece or workpieces, i.e., grinding in a direction along the first axis 1, to also include lateral grinding of the workpiece or workpieces in a perpendicular direction along the third axis 3'.

Embodiments of the present invention have been described above, and it is to be understood that the invention is not limited to the disclosed embodiments. To the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A motorized blade rest apparatus for a grinding system, the apparatus comprising:

a movable carriage structured for supporting a regulating wheel for movement along a first axis towards and away from a work wheel;

a movable ram assembly structured for movement along a second axis towards and away from the work wheel, wherein the carriage is supported by the ram assembly, and wherein the first axis is parallel to the second axis;

a work rest assembly supported by the ram assembly, the work rest assembly including:

a first slide portion mounted on the ram assembly, a movable second slide portion structured for movement along a third axis perpendicular to the first axis, the second slide portion being movable relative to the first slide portion, and a work rest blade mounted on the second slide portion and structured to support a workpiece to be ground by the work wheel;

a work rest motor operatively coupled to the second slide portion to move the second slide portion along the third axis; and a computer processor operatively coupled to the work rest motor and programmed to control the work rest motor to controllably move the second slide portion along the third axis.

2. The motorized blade rest apparatus according to claim 1, further comprising a first motor operatively coupled to the carriage, wherein the computer processor is operatively coupled to the first motor and is programmed to control the first motor to controllably move the carriage along the first axis towards and away from the work wheel.

3. The motorized blade rest apparatus according to claim 2, wherein the computer processor controls the work rest motor independently of the first motor, such that the second slide portion is controlled to move along the third axis independently of movement of the carriage along the first axis.

4. The motorized blade rest apparatus according to claim 3, wherein the computer processor controls the first motor and the work rest motor to move the carriage and the second slide portion simultaneously, such that the second slide portion is controlled to move along the third axis while the carriage is moved along the first axis.

5. The motorized blade rest apparatus according to claim 2, further comprising a second motor operatively coupled to the ram assembly, wherein the computer processor is operatively coupled to the second motor and is programmed to control the second motor to controllably move the ram assembly along the second axis towards and away from the work wheel.

6. The motorized blade rest apparatus according to claim 5, wherein the computer processor controls the first motor, the second motor, and the work rest motor independently of each other, such that the carriage, the second slide portion, and the ram assembly are controllably movable independent of each other.

7. The motorized blade rest apparatus according to claim 1, wherein, during a grinding operation on the workpiece, the work rest motor is controlled by the computer processor to move the second slide portion along the third axis while the workpiece is being ground.

8. The motorized blade rest apparatus according to claim 1, wherein the computer processor is programmed to control the work rest motor to controllably move the second slide portion such that the workpiece is ground to a predetermined shape.

9. The motorized blade rest apparatus according to claim 2, wherein, during a grinding operation on the workpiece, the first motor is controlled by the computer processor to move the carriage along the first axis and the work rest motor is controlled by the computer processor to move the second slide portion along the third axis while the workpiece is being ground.

10. The motorized blade rest apparatus according to claim 9, wherein, the first motor and the work rest motor are controlled by the computer processor to move the carriage and the second slide portion simultaneously while the workpiece is being ground.

11. The motorized blade rest apparatus according to claim 9, wherein, the first motor and the work rest motor are controlled by the computer processor to move the carriage and the second slide portion sequentially while the workpiece is being ground.

12. The motorized blade rest apparatus according to claim 1, wherein the second slide portion is mounted for movement on a rail supported by the first slide portion.

13. The motorized blade rest apparatus according to claim 1, further comprising a carriage rail on which the carriage is mounted for movement along the first axis.

14. The motorized blade rest apparatus according to claim 1, wherein the work rest motor is a stepper motor.

15. The motorized blade rest apparatus according to claim 1, further comprising a ram-assembly rail on which the ram assembly is mounted for movement along the second axis.

16. The motorized blade rest apparatus according to claim 1, wherein the work rest motor is a servo motor.

17. The motorized blade rest apparatus according to claim 1, wherein the work rest motor includes an encoder.

18. The motorized blade rest apparatus according to claim 17, wherein the encoder is one of: a linear encoder, a rotary encoder, and an open encoder.

19. The motorized blade rest apparatus according to claim 1, wherein the work rest motor does not include an encoder.

20. A grinding system comprising:

a work wheel arranged to grind a workpiece;

a grinding motor arranged to cause rotation of the work wheel;

a regulating wheel arranged to brace the workpiece against the work wheel during grinding;

a motorized blade rest apparatus arranged to hold and transport the workpiece during grinding, the apparatus including:

a movable carriage structured for supporting the regulating wheel for movement along a first axis towards and away from the work wheel, a movable ram assembly structured for movement along a second axis towards and away from the work wheel, wherein the carriage is supported by the ram assembly, and wherein the first axis is parallel to the second axis, a work rest assembly supported by the ram assembly, the work rest assembly including:

a first slide portion mounted on the ram assembly, a movable second slide portion structured for movement along a third axis perpendicular to the first axis, the second slide portion being movable relative to the first slide portion, and a work rest blade mounted on the second slide portion and structured to support the workpiece to be ground by the work wheel, a work rest motor operatively coupled to the second slide portion to move the second slide portion along the third axis; and a computer processor operatively coupled to the work rest motor and programmed to control the work rest motor to controllably move the second slide portion along the third axis.

21. The grinding system according to claim 20, further comprising a first motor operatively coupled to the carriage, wherein the computer processor is operatively coupled to the first motor and is programmed to control the first motor to controllably move the carriage along the first axis towards and away from the work wheel.

22. The grinding system according to claim 21, wherein the computer processor controls the work rest motor independently of the first motor, such that the second slide portion is controlled to move along the third axis independently of movement of the carriage along the first axis.

23. The grinding system according to claim 22, wherein the computer processor controls the first motor and the work rest motor to move the carriage and the second slide portion simultaneously, such that the second slide portion is controlled to move along the third axis while the carriage is moved along the first axis.

24. The grinding system according to claim 21, further comprising a second motor operatively coupled to the ram assembly, wherein the computer processor is operatively coupled to the second motor and is programmed to control the second motor to controllably move the ram assembly along the second axis towards and away from the work wheel.

25. The grinding system according to claim 24, wherein the computer processor controls the first motor, the second motor, and the work rest motor independently of each other, such that the carriage, the second slide portion, and the ram assembly are controllably movable independent of each other.

26. The grinding system according to claim 20, wherein, during a grinding operation on the workpiece, the work rest motor is controlled by the computer processor to move the second slide portion along the third axis while the workpiece is being ground.

27. The grinding system according to claim 20, wherein the computer processor is programmed to control the work rest motor to controllably move the second slide portion such that the workpiece is ground to a predetermined shape.

28. The grinding system according to claim 21, wherein, during a grinding operation on the workpiece, the first motor is controlled by the computer processor to move the carriage along the first axis and the work rest motor is controlled by the computer processor to move the second slide portion along the third axis while the workpiece is being ground.

29. The grinding system according to claim 28, wherein, the first motor and the work rest motor are controlled by the computer processor to move the carriage and the second slide portion simultaneously while the workpiece is being ground.

30. The grinding system according to claim 28, wherein, the first motor and the work rest motor are controlled by the computer processor to move the carriage and the second slide portion sequentially while the workpiece is being ground.

31. The grinding system according to claim 20, wherein the second slide portion is mounted for movement on a rail supported by the first slide portion.

32. The grinding system according to claim 20, further comprising a carriage rail on which the carriage is mounted for movement along the first axis.

33. The grinding system according to claim 20, wherein the work rest motor is a stepper motor.

34. The grinding system according to claim 20, further comprising a ram-assembly rail on which the ram assembly is mounted for movement along the second axis.

35. The grinding system according to claim 20, wherein the work rest motor is a servo motor.

36. The grinding system according to claim 20, wherein the work rest motor includes an encoder.

37. The grinding system according to claim 36, wherein the encoder is one of: a linear encoder, a rotary encoder, and an open encoder.

38. The grinding system according to claim 20, wherein the work rest motor does not include an encoder.

39. A method of grinding a workpiece using a grinding system, the method comprising steps of:

loading the workpiece in a motorized blade rest apparatus of the system, the apparatus including:

a movable carriage structured for supporting a regulating wheel for movement along a first axis towards and away from a work wheel, a movable ram assembly structured for movement along a second axis towards and away from the work wheel, wherein the carriage is supported by the ram assembly, and wherein the first axis is parallel to the second axis, a work rest assembly supported by the ram assembly, the work rest assembly including:

a first slide portion mounted on the ram assembly, a movable second slide portion structured for movement along a third axis perpendicular to the first axis, the second slide portion being movable relative to the first slide portion, and a work rest blade mounted on the second slide portion and structured to support a workpiece to be ground by the work wheel;

a work rest motor operatively coupled to the second slide portion to move the second slide portion along the third axis, and a computer processor operatively coupled to the work rest motor and programmed to control the work rest motor to controllably move the second slide portion along the third axis; and controlling, via the computer processor, the work rest motor to move the second slide portion along the third axis during a grinding operation on the workpiece.

40. The method of grinding a workpiece according to claim 39, wherein, in the controlling step, the second slide portion is moved during grinding of the workpiece by the work wheel.

41. The method of grinding a workpiece according to claim 39, wherein, in the controlling step, the second slide portion is moved when the work wheel is not grinding the workpiece.

* * * * *